US006152810A

United States Patent [19]

Drenter

[11] Patent Number: 6,152,810

[45] Date of Patent: Nov. 28, 2000

[54] BLASTING MEDIA APPARATUS

[75] Inventor: John C. Drenter, Davenport, Iowa

[73] Assignee: PCT, Inc., Davenport, Iowa

[21] Appl. No.: 09/110,610

[22] Filed: Jul. 6, 1998

Related U.S. Application Data

[63] Continuation of application No. 08/675,919, Jul. 5, 1996, abandoned.

[51] Int. Cl.[7] ..... B24C 3/00

[52] U.S. Cl. ..... 451/75; 451/99; 451/100; 451/101; 451/88

[58] Field of Search ..... 451/75, 99, 100, 451/101, 102, 88, 64, 87, 89, 91, 92

[56] References Cited

U.S. PATENT DOCUMENTS

| | | | |
|---|---|---|---|
| 879,102 | 2/1908 | Hay . | |
| 1,016,415 | 2/1912 | Jorn, Jr. . | |
| 1,443,762 | 1/1923 | Smith . | |
| 2,371,434 | 3/1945 | Eppler . | |
| 2,443,148 | 6/1948 | Rucki . | |
| 2,455,514 | 12/1948 | Mead | 451/88 |
| 2,569,952 | 10/1951 | Ridley . | |
| 2,580,842 | 1/1952 | Ruemelin . | |
| 2,594,072 | 4/1952 | Ridley . | |
| 2,597,434 | 5/1952 | Bishop et al. | 451/88 |
| 2,810,991 | 10/1957 | Mead et al. | 451/88 |
| 3,073,070 | 1/1963 | Mead | 451/88 |
| 4,019,284 | 4/1977 | Hileman, Jr. . | |
| 4,164,103 | 8/1979 | Hesse et al. | 451/88 |
| 4,744,181 | 5/1988 | Moore et al. . | |
| 4,984,397 | 1/1991 | Van Leeuwen . | |
| 5,024,029 | 6/1991 | Abbott et al. . | |
| 5,056,275 | 10/1991 | Wada et al. . | |
| 5,107,630 | 4/1992 | Lodewijk . | |
| 5,201,150 | 4/1993 | Kuboyama et al. . | |
| 5,230,185 | 7/1993 | Kirschner et al. . | |
| 5,421,767 | 6/1995 | Spears, Jr. et al. . | |
| 5,431,594 | 7/1995 | Shank, Jr. . | |
| 5,481,832 | 1/1996 | Tirikos . | |
| 5,529,530 | 6/1996 | McPhee et al. . | |
| 5,709,593 | 1/1998 | Guthrie et al. | 451/285 |

FOREIGN PATENT DOCUMENTS

| | | |
|---|---|---|
| 73632 | 1/1952 | Denmark . |

*Primary Examiner*—Derris H. Banks
*Attorney, Agent, or Firm*—Woodard, Emhardt, Naughton, Moriarty & McNett

[57] ABSTRACT

An apparatus for the introduction of a blasting media into a high velocity, high pressure fluid stream. In one embodiment of the present invention a dual chambered pressure vessel has a pair of auxiliary actuated pop-up valves that are cycled at a high rate to provide continuous delivery of the blasting media to the work surface. The pressure vessel having a blasting media flow control valve coupled with the pressure vessel for controlling the flow of blasting media into the vessel.

35 Claims, 8 Drawing Sheets

BLASTING MEDIA APPARATUS

The application is a continuation of Ser. No. 08/675,919 filed Jul. 5, 1996, now abandoned.

BACKGROUND OF THE INVENTION

The present invention relates generally to the design and construction of an apparatus for the introduction of a blasting media into a high velocity, high pressure fluid stream. More particularly, the present invention has one embodiment wherein a dual chambered pressure vessel has a pair of auxiliary actuated pop-up valves that are cycled at a relatively high rate to provide delivery of the blasting media to the high velocity high pressure fluid stream.

It is well known that the application of a pressurized blasting media transported by a high pressure, high velocity fluid has been utilized for well over a century for things such as the removal of paint and other coatings, removal of rust, cutting of substrates, and other surface conditioning. Many of the projects in need of surface conditioning are physically large, such as petroleum storage tanks, bridges, and buildings. Many of these projects may take a few days, weeks, or longer to complete. Further, the very nature of many of these projects is such that the structure is practically immovable and the blasting media apparatus must be brought to the job site.

Many prior conventional blasting media apparatuses have a pneumatically operated system that utilizes refillable blasting media reservoirs to furnish the blasting media. The refilling of the blasting media reservoirs in the prior designs generally require extra manpower, equipment, and lost work time while the reservoirs are being refilled. More specifically, conventional blasting pot apparatuses include a pressure vessel that is partially filled with an abrasive blasting media, and coupled to the top of the pressure vessel is a valve openable for allowing the vessel to be refilled with blasting media. After a sufficient quantity of blasting media has been accumulated within the pressure vessel, pressurized air is introduced into the vessel thereby closing the valve and forcing the blasting media into the high pressure high velocity air stream for delivery to a blasting nozzle.

A common limitation associated with conventional blast pot apparatuses is that they are batch type devices, thereby necessitating stopping the blasting operation while the pressure vessel is filled with blasting media. In an effort to increase the uninterrupted blasting time available to the machine operator many prior designers of conventional blast pot apparatuses have increased the volume and physical size of the pressure vessel in order to hold more blasting media. Thus there are numerous machines available with blasting media storage capacities of as much as twenty (20) plus tons of blasting media. However, increasing the pressure vessel size often results in a cumbersome machine that is difficult to transport to a job site and does not eliminate the inherent limitation of a batch type device that requires stopping the blasting operation in order to refill the pressure vessel with blasting media.

A blasting machine utilizing a dual chambered pressure vessel with an upper and lower reservoir has been utilized in an attempt to minimize the limitations associated with a batch type blasting machine. While some of the prior dual chambered blasting systems strive to function as continuous blasting apparatuses they have associated therewith numerous problems which has limited their acceptance in the marketplace. One limitation is associated with the pressure vessel requiring a significant amount of pressurized fluid flow in order to close the pop-up valve between the upper and lower reservoirs. During the period of closing the pop-up valve a substantial pressure drop often occurs in the pressure vessel, thereby disrupting the delivery of blasting media into the high pressure high velocity air stream. The disruption of the blasting media flow causes changes in the air flow and blasting patterns that greatly disrupt the blasting machine operators ability to maintain an efficient work rhythm.

Many dual chamber blasting media systems, in an apparent effort to minimize the above pop-up valve closing problem, have increased the volume of the pressure vessel. By continuing to increase the pressure vessels size many systems have become physically cumbersome, and the increased pressure vessel volume generally requires an increase in the fluid flow required to close the pop-up valve thereby further aggravating the pressure drop phenomenon. Further, many prior blasting media machines couple multiple working station outlets to one centralized pressure vessel, which means that if one outlet requires maintenance then all of the outlets must be stopped.

Although the prior dual chamber blasting media machines are steps in the right direction the need for additional improvements still remains. The present invention satisfies this need in a novel and unobvious way.

SUMMARY OF THE INVENTION

One form of the present invention contemplates a blasting media apparatus. The apparatus introduces blasting media into a fluid stream for delivery to a surface, comprising: a mechanical housing for the receipt of blasting media therein, a portion of the housing being open to ambient conditions; and a plurality of gravity fed plural chambered blasting pots coupled to the mechanical housing, the plurality of blasting pots receiving blasting media from the housing and releasing the blasting media into the fluid stream One object of the present invention is to provide an improved blasting media machine.

Related objects and advantages of the present invention will be apparent from the following description.

DESCRIPTION OF THE PREFERRED EMBODIMENT

Figure 1:
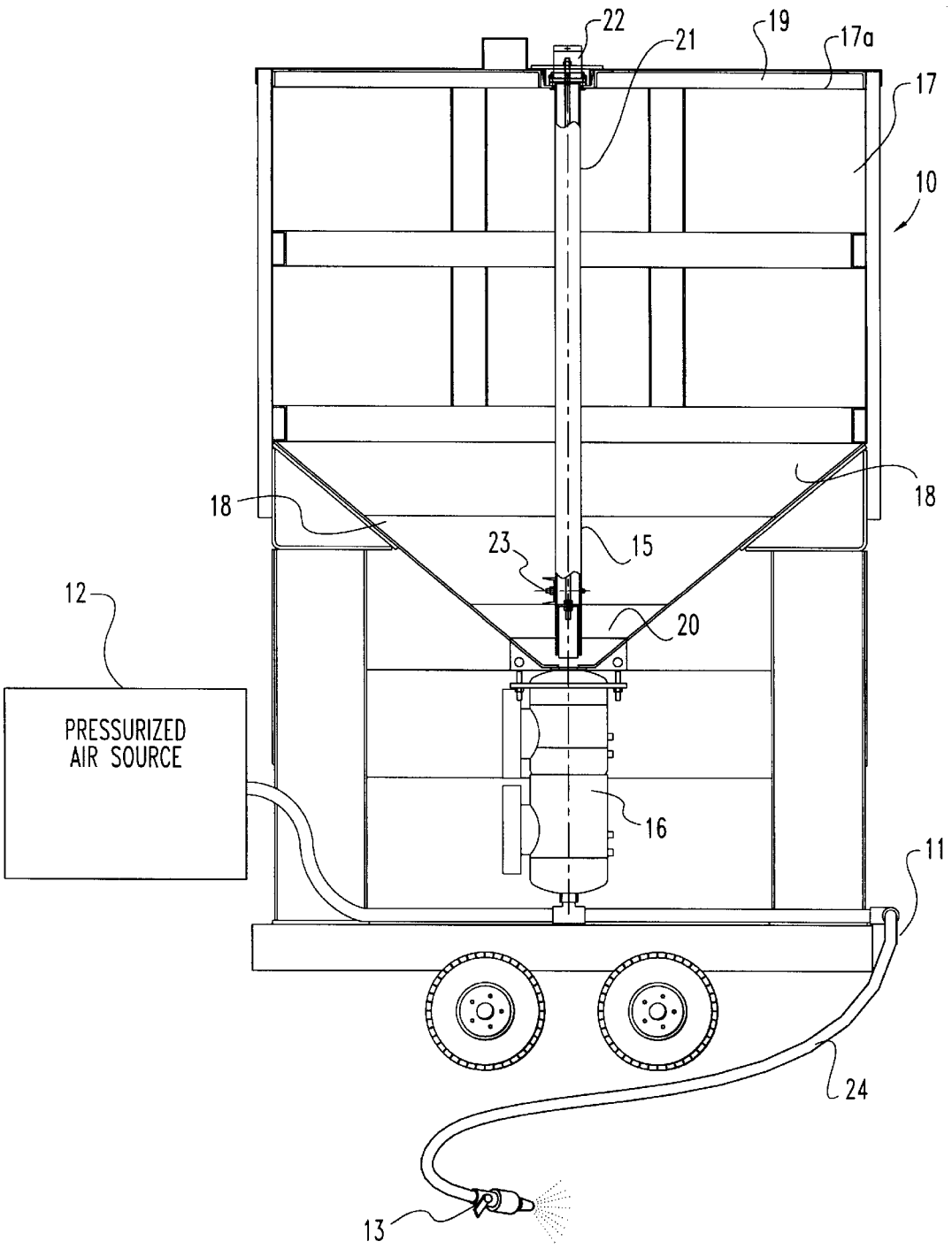
FIG. 1 is an illustrative sectional view taken at a typical blast pot location of one embodiment of the blasting media apparatus of the present invention

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a side elevational view in section of one embodiment of the blasting media apparatus 10. For the convenience of the reader the blasting media apparatus 10 has been illustrated in section at one of a plurality of blasting pots 16. It is understood that blasting media apparatuses having one or more blasting pots 16 are contemplated herein. In the preferred embodiment the blasting media apparatus 10 is coupled to a mobile apparatus 11 thereby allowing greater convenience in transporting the blasting media apparatus 10 over the public road network to job sites. The blasting media apparatus 10 can be fixedly mounted at a specific site, coupled to a delivery vehicle, coupled to a wheeled trailer, and deployed by other means that enable the blasting media apparatus 10 to be useable at job sites.

In the preferred embodiment the pressurizable dual chamber blasting pot 16 is coupled to a mechanical housing 17; the mechanical housing 17 being a substantially rigid structure having a top portion 17*a* at substantially atmospheric pressure. The mechanical housing 17 is designed and constructed to receive a substantial quantity of blasting media therein. The selection of the appropriate blasting media for a specific job is dependent upon the surface characteristics desired of the item being conditioned. Blasting media includes but is not limited to the following; sand, steel shot, steel grit and other abrasive material.

In the preferred embodiment the mechanical housing 17 includes a plurality of sloped sides 18 for funneling the blasting media to the blasting pots 16. Further, the mechanical housing 17 includes a plurality of ribs and supporting structures to add additional physical strength thereto. In the preferred embodiment a blasting media flow control valve 15 is coupled to an upper supporting member 19 and a lower supporting member 20. The blasting media flow control valve 15 being actuated by a pneumatic cylinder 22 that is coupled to the valve 15 through a connecting rod 23. The blasting media flow control valve 15 is for controlling the passage of blasting media from the mechanical housing 17 into the blasting pot 16. More particularly, the blasting media flow control valve 15 being an active device for disabling the flow of media. Further, blasting media flow control valve 15 minimizes and/or eliminates the flow of blasting media to a specific blast pot 16 without having to close the blast pot's fluid tight seal.

Figure 7:
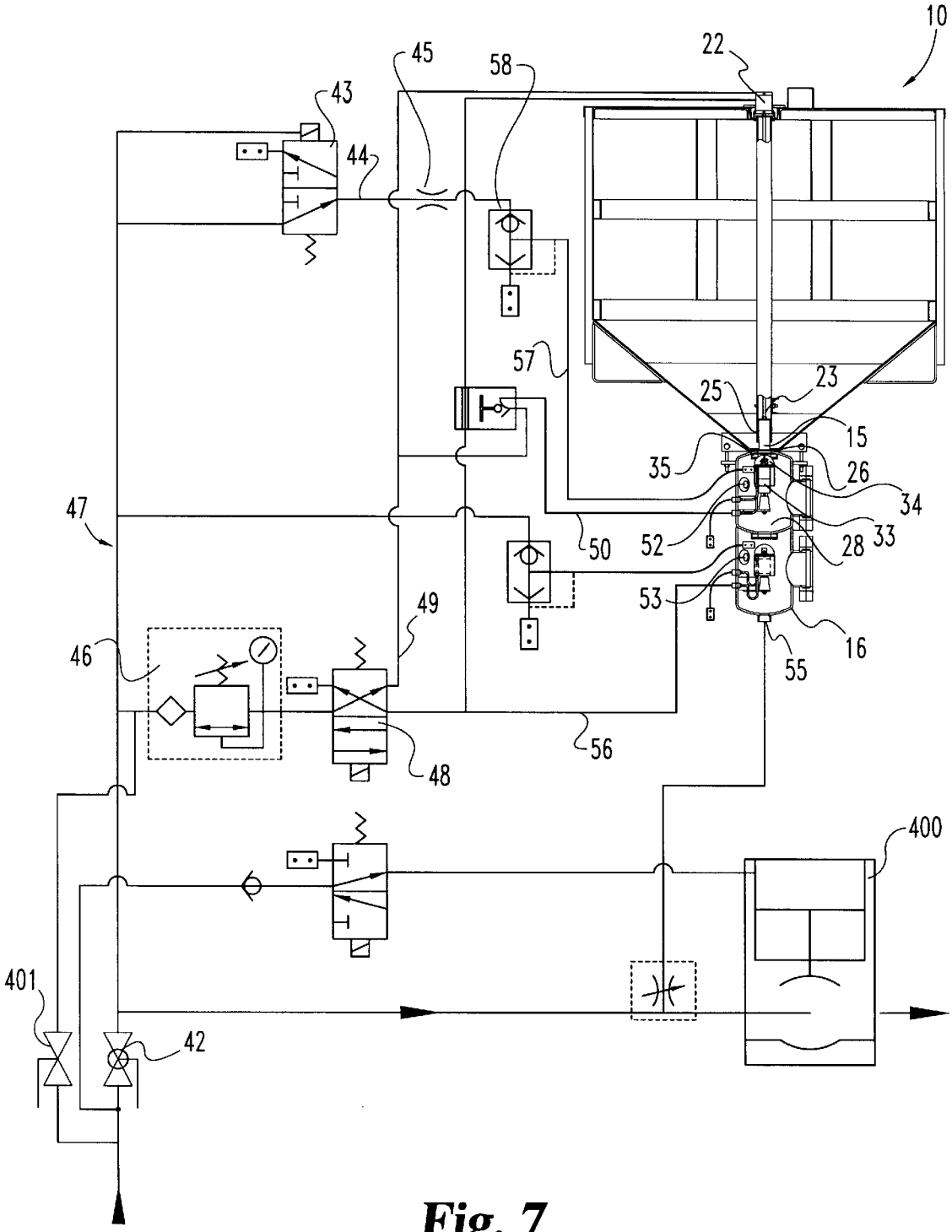
FIG. 7 is a schematic representation of one embodiment for controlling the FIG. 1 blasting media apparatus.

The blasting media apparatus 10 utilizes a supply of substantially high pressure high volume fluid to transport the blasting media exiting the blast pot 16 to the work surface. It is understood that each of the blasting pots 16 within the blasting apparatus 10 has an individual high pressure high velocity fluid stream for transporting the blasting media. A high pressure flexible hose 24 for the passage of the blasting material and pressurized fluid, with a nozzle 13 thereon allows the operator much freedom in mobility while directing the pressurized blasting media stream onto the work surface. A pinch valve 400 (FIG. 7) is coupled to the flexible hose 24 to enable the operator to shut-off the flow of material from the hose. In the preferred embodiment the pinch valve 400 compresses and collapses the hose to prevent material flow therefrom. In the preferred embodiment the fluid is air and the pressure source is an air compressor 12 that is coupled to the blasting apparatus 10. It is understood that the source of compressed air can be remote from the blasting media apparatus 10. One form of the present invention utilizes a large air compressor having about four hundred horsepower. In the preferred embodiment the control of the blasting media apparatus 10 is substantially accomplished with pneumatic valves and actuators. However, other control structures are contemplated herein.

Figure 2:
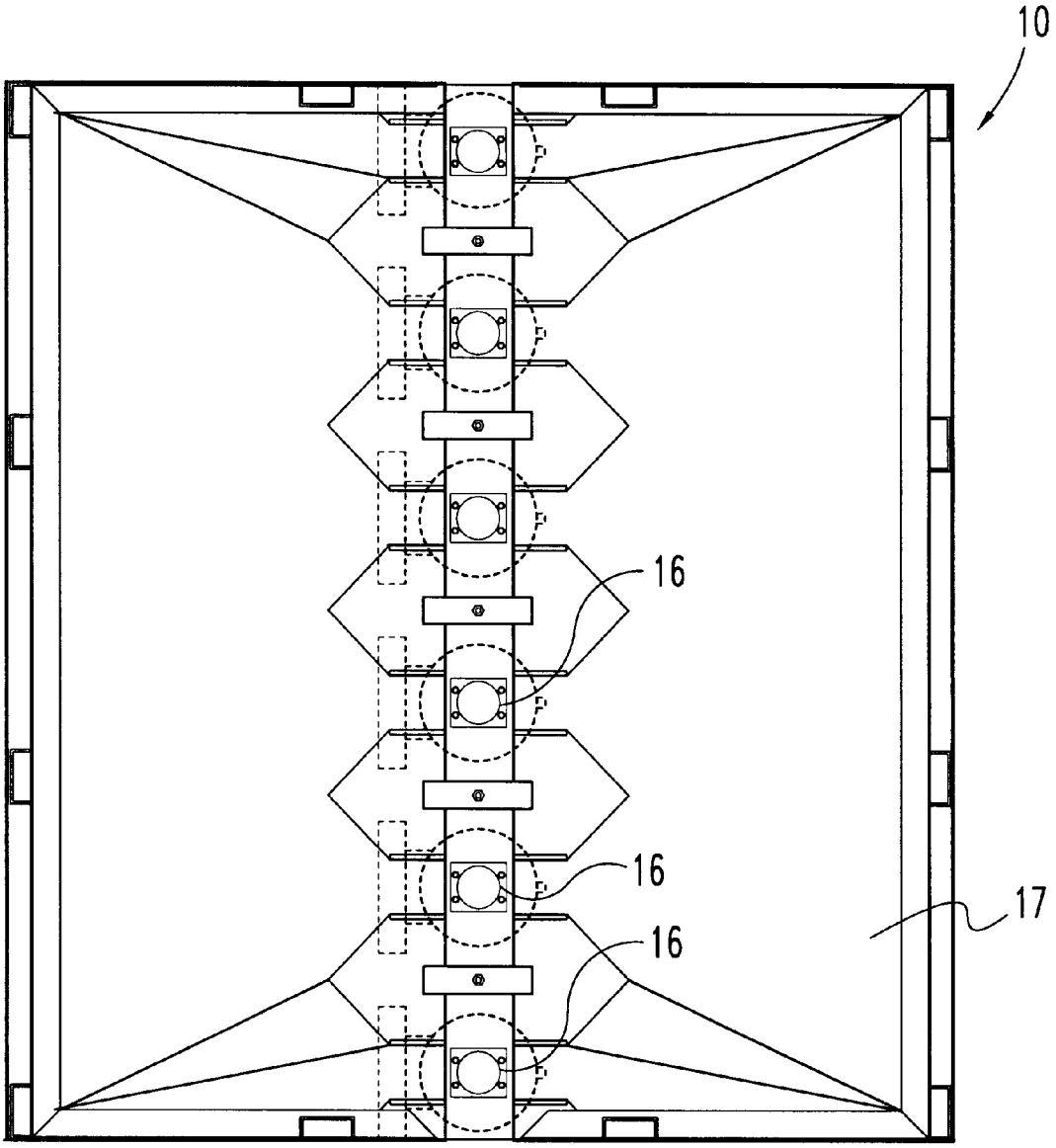
FIG. 2 is a top plan view of one embodiment of the blasting media apparatus of the present invention.

With reference to FIG. 2, there is illustrated a top plan view of the blasting media apparatus 10 having a plurality of blast pots 16 coupled thereto. The number of blast pots 16 within the blasting media apparatus 10 is within a range of 1 to 50. While the blasting media apparatus 10 may have only one blast pot 16 it is preferred that there is a plurality of blast pots 16 coupled to the mechanical housing 17. In the preferred embodiment there are six blast pots 16 coupled to housing 17. In the preferred embodiment each of the blast pots 16 being individually controllable.

Figure 3A:
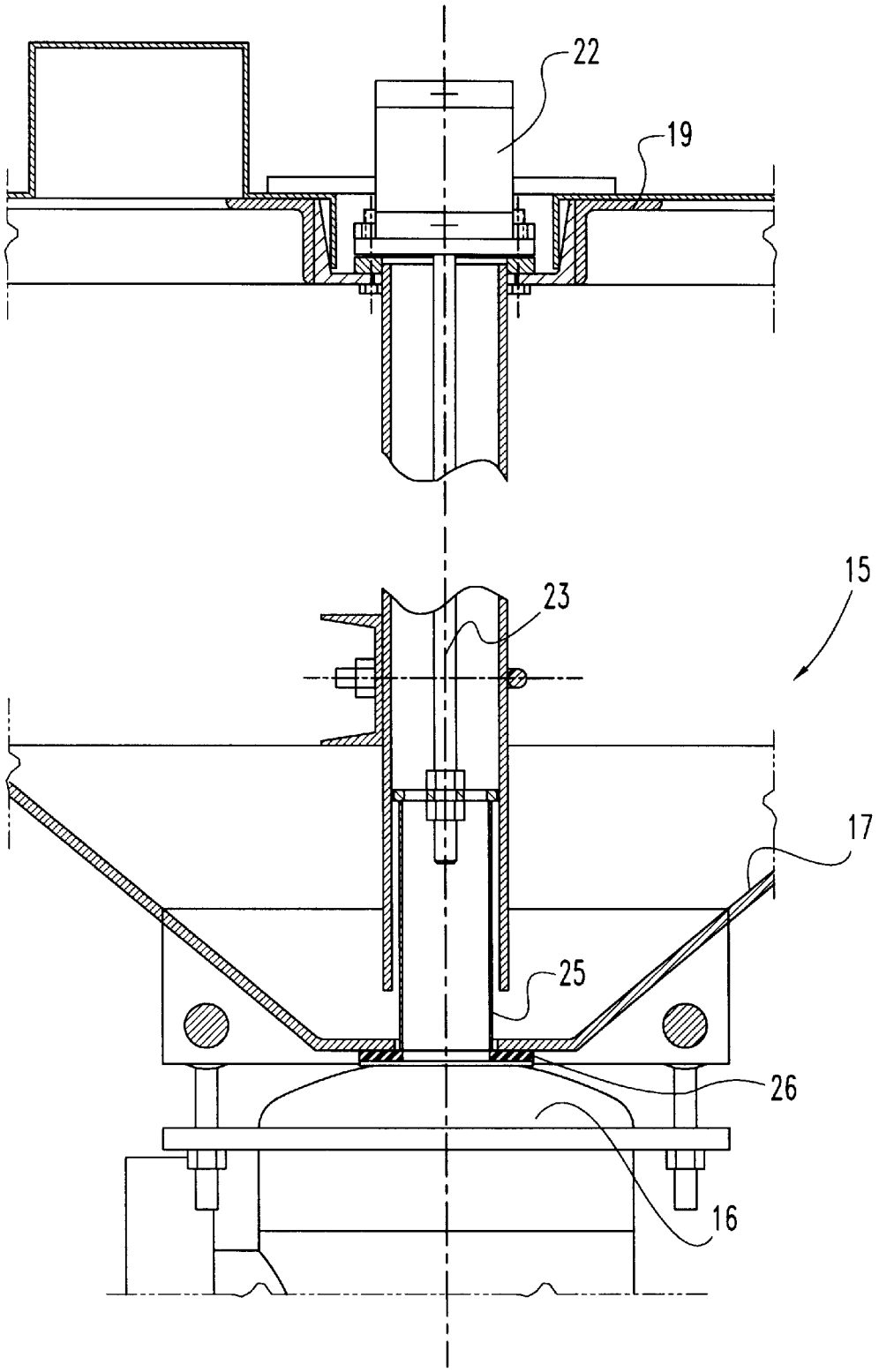
FIG. 3*a* is a partial enlarged view of the blasting media flow control valve comprising a portion of the FIG. 1 blasting media apparatus in a closed position.
Figure 3B:
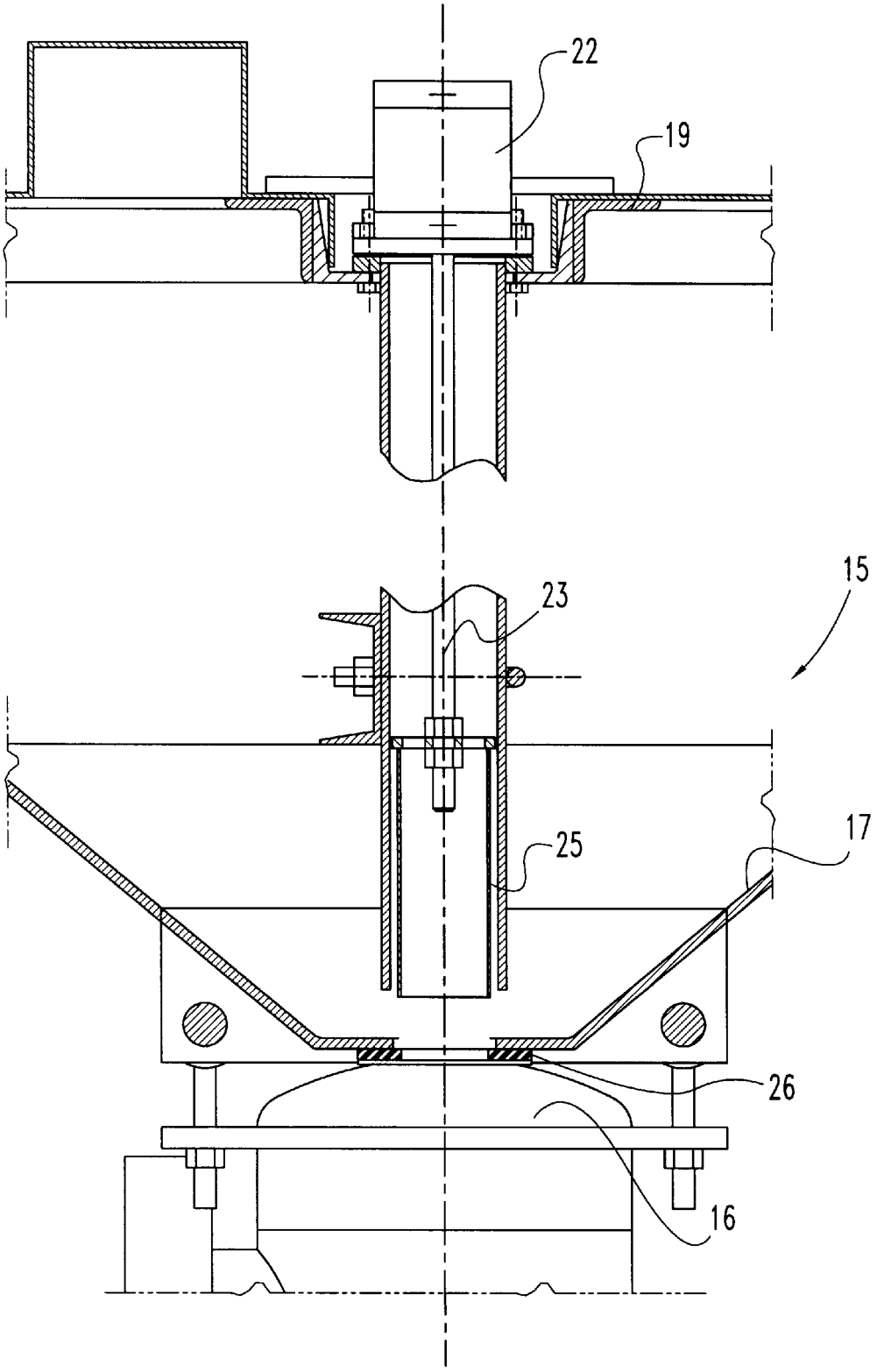
FIG. 3*b* is a partial enlarged view of the blasting media flow control valve comprising a portion of the FIG. 1 blasting media apparatus in an open position.

With reference to FIGS. 3*a* and 3*b*, there are illustrated enlarged views of the blasting media flow control valve in an actuated and unactuated state. More particularly in FIG. 3*a*, the moveable cylindrical sealing member 25 is disposed in an abutting relationship with a valve seat 26. The engagement of the annular sealing member 25 with valve seat 26 for preventing the passage of blasting media into the blast pot 16. In the preferred embodiment an auxiliary actuation device such as air cylinder 22 is actuated to displace the connecting rod 23 such that the cylindrical sealing member 25 is held in a substantial sealing arrangement with valve seat 26. By substantially preventing the flow of blasting media into the blast pot 16 just prior to the closing of the fluid tight seal (not illustrated), wherein the fluid tight seal is for allowing the pressurization of blast pot 16, a substantially improved fluid tight seal is obtained. With reference to FIG. 3*b*, there is illustrated the blasting media flow control valve 15 in an open position thereby allowing the passage of blasting media to the blast pot 16. In the preferred embodiment the blasting media enters the blast pot 16 from the mechanical housing 17 at a relatively high flow rate. Sealing member 25 is withdrawn from the valve seat 26, and when the fluid tight seal (not illustrated) is in an open position the blasting media flows into the blast pot 16.

Figure 4:
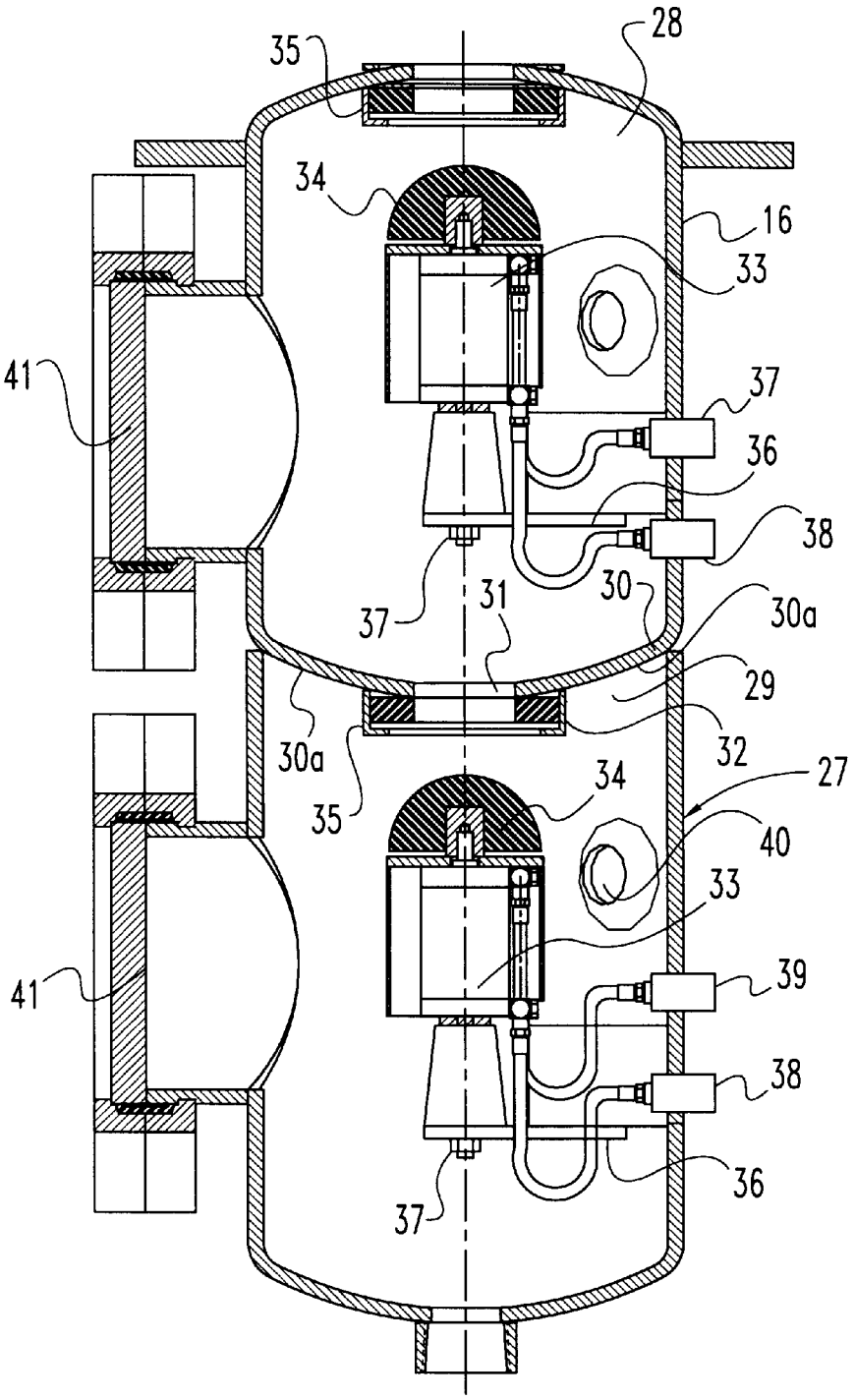
FIG. 4 is a sectional view of the blasting pot comprising a portion of the FIG. 1 blasting media apparatus.

With reference to FIG. 4, there is illustrated a sectional view of one of the plurality of blast pots 16. Blast pot 16 includes a pressure vessel 27 having a first upper independently pressurizable chamber 28 and a second lower independently pressurizable chamber 29. In the preferred embodiment the pressure vessel 27 is constructed of a cylindrical pipe capable of withstanding pressures above 150 pounds per square inch gage. In one form of the present invention each of the chambers have about an eight inch inside diameter and a height of about twelve inches. However, other sizes and forms of pressure vessels are contemplated herein. A dividing member 30 separates the first upper chamber 28 and the second lower chamber 29. Formed through dividing member 30 is a passageway 31 to allow for the passage of fluid and blasting media between the first upper chamber 28 and the second lower chamber 29. In one embodiment of pressure vessel 27 the cross sectional area of passageway 31 is about 1/20 the of the cross sectional area of the second lower chamber 29. In the preferred embodiment passageway 31 is a circular aperture having a cross sectional area of about 1/16 the of the cross sectional area of the second lower chamber 29. Dividing member 30 forming a sloped upper surface 30*b* to facilitate blasting media passing from the first upper chamber 28 through passageway 31 and into the second lower chamber 29. It is understood that other geometric shapes for dividing member 30 are contemplated herein.

Coupled to the lower surface 30*a* of the dividing member 30 is a valve seat 32. The valve seat 32 being designed and constructed to receive a sealing surface 34 of pop-up valve 33 thereagainst. In the preferred embodiment the sealing surface 34 of pop-up valve 33 is a half sphere contactable with a sealing gasket 35. The sealing surface being formed of a material such as polyurethane. The pop-up valve 33 being removeably mounted within the second lower chamber 29 by a mounting bracket 36 that is welded to pressure vessel 27. Bracket 36 being coupled to pop-up valve 33 by a fastener 37. A pair of high pressure hoses 38 and 39 that extend outside of the pressure vessel 27 are coupled to and in fluid communication with the pop-up valve 33. Pop-up valve 33 being closeable independently of the chamber pressures, and in the preferred embodiment is actuated to close when their is no pressure differential between the vessel 27 and the surrounding environment. The high pressure hoses 38 and 39 in the preferred embodiment are connected to the pneumatic controls network in order to actuate the pop-up valve 33.

Positioned within the second lower chamber 29 is a blasting media level sensor 53 that is utilized to sense the presence of blasting media. Further, an access panel 41 is coupled to the vessel 27 to allow access into the second lower chamber 29 for maintaining and replacing parts from within the chamber. The second lower chamber having an exit aperture 110 therein at about its lowest point for allowing the discharge of blasting media from the blasting pot 16. In the preferred embodiment the exit aperture 110 has a smaller cross-sectional area than the cross-sectional area of passageway 31. The first upper chamber 28 includes substantially identical components as described for the second lower chamber 29 and will have like figure numbers.

Figure 5A:
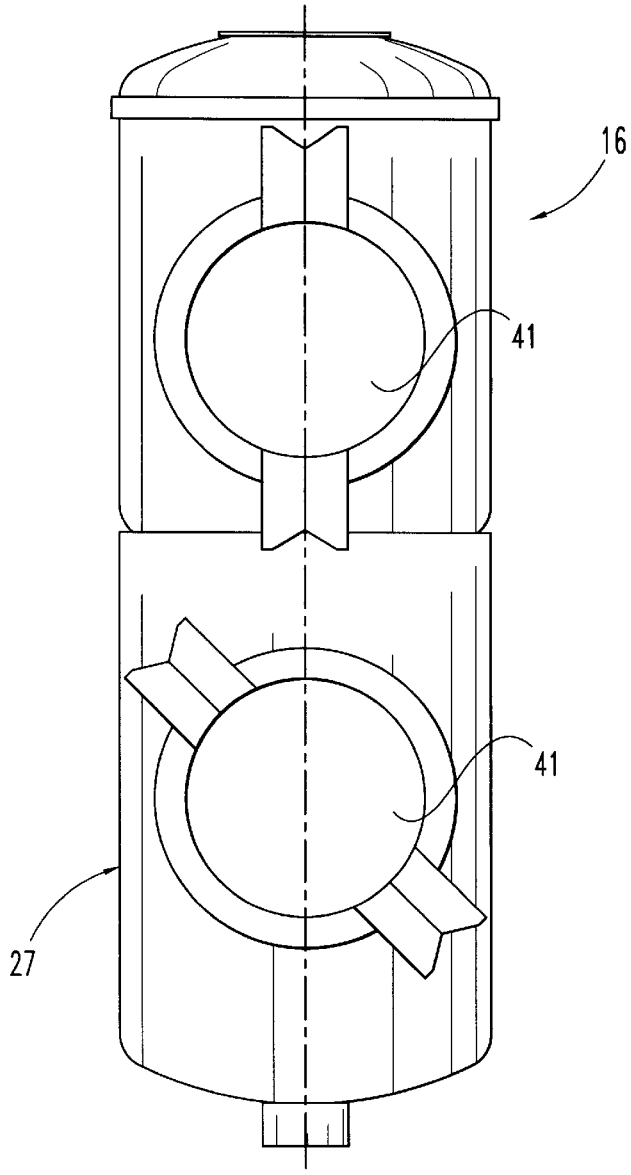
FIG. 5*a* is a rear elevational view of the blasting pot comprising a portion of the FIG. 1 blasting media apparatus.
Figure 5B:
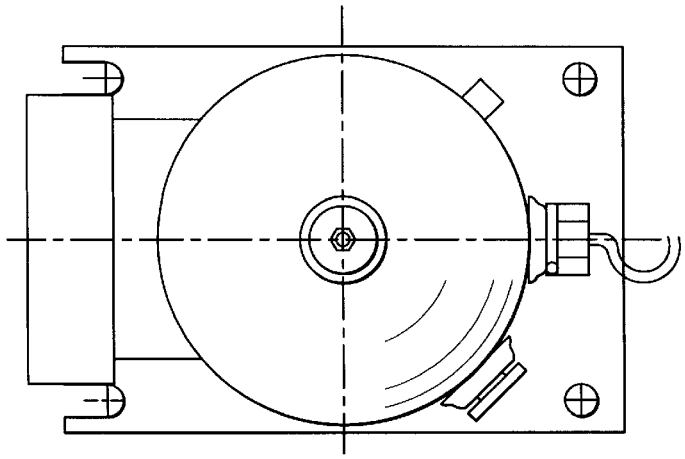
FIG. 5*b* is a top plan view of the FIG. 5*a* blasting pot.
Figures 6A, 6B, 6C, 6D:
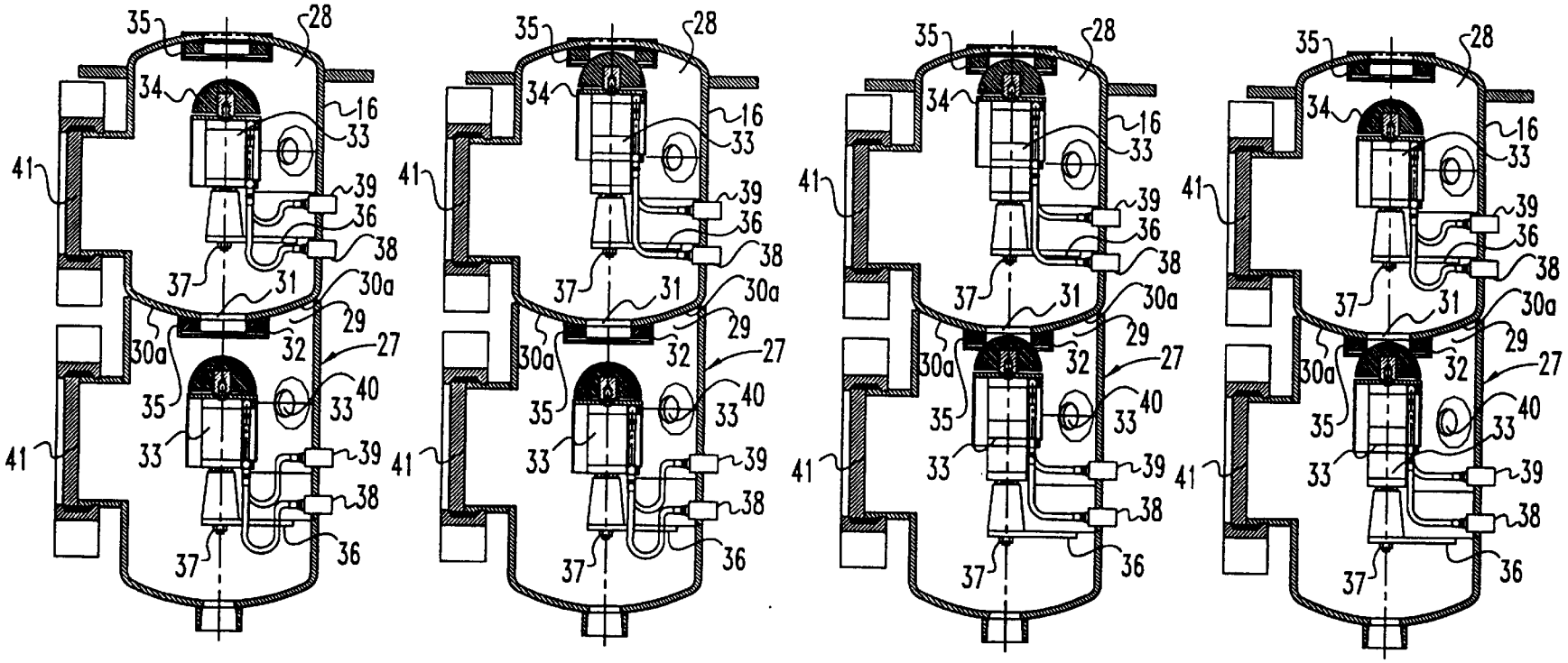
FIG. 6*a* is a side elevational view in section of the blasting pot comprising a portion of the FIG. 1 blasting media apparatus, the blasting pot having a pair of auxiliary actuated valves therein disposed in an open position.
FIG. 6*b* is a side elevational view in section of the blasting pot comprising a portion of the FIG. 1 blasting media apparatus, the blasting pot having a pair of auxiliary actuated valves therein with the upper valve in a closed position and the lower valve in an open position.
FIG. 6*c* is a side elevational view in section of the blasting pot comprising a portion of the FIG. 1 blasting media apparatus, the blasting pot having a pair of auxiliary actuated valves therein disposed in a closed position.
FIG. 6*d* is a side elevational view in section of the blasting pot comprising a portion of the FIG. 1 blasting media apparatus, the blasting pot having the upper valve in an open position and the lower valve in a closed position.

With reference to FIGS. 5*a* and 5*b*, there are illustrated two views of the dual chamber blast pot 16. With particular reference to FIG. 5*a*, there is illustrated the pair of external access panels 41 that allow access into the upper 28 and lower 29 chambers respectively.

With reference to FIGS. 6*a*–6*d* and 7, the operation of the blasting media apparatus 10 will be explained. A valve 42 controls the passage of pressurized fluid from the pressurized fluid source 12 to blast pot 16. Each of the plurality of blast pots 16 having a valve 42 associated therewith, and in the preferred embodiment the valve 42 is a ball type valve. Upon placing the valve 42 in a closed position the specific blast pot 16 is isolated from the pressurized fluid source 12 to allow the depressurization of the respective blast pot 16, and to enable the removal of one of the plurality of blast pots 16 without disrupting the other blast pots. A valve 401 controls the passage of fluid from the pressurized fluid source 12 into the control passageways 47 of blasting media apparatus 10.

The operation of the blasting media apparatus 10 will now be explained with the assistance of processing steps. Blasting media apparatus 10 being designed and constructed to provide the continuous delivery of blasting media to the work surface being conditioned. In a first step an upper chamber pressurization valve 43 is positioned in a closed state. In the preferred embodiment the upper chamber pressurization valve 43 being a electrically controlled pneumatic valve that is opened and closed so as to direct the passage of fluid therefrom. With the upper chamber pressurization valve 43 in a closed state pressurized fluid is allowed to pass through passageway 44 into the first upper chamber 28. In the preferred embodiment a reduced fixed orifice flow control device 45 is utilized to limit the rate of pressurization of the first upper chamber 28 so as to reduce the pressure drop within the control network passageways 47. In another form of the present invention a variable orifice flow control valve is utilized to limit the rate of pressurization of the upper chamber 28. A pressure regulator 46 is positioned within the control network 47 for setting the fluid pressure. A pneumatically operated sequencing valve 48 is coupled to the control network 47 and actuated to direct the pressurized fluid stream to select passageways therein. In the first step sequencing valve 48 is in an off position thereby allowing pressurized fluid to flow through passageway 49 to air cylinder 22 which controls the blasting media flow control valve 15.

The pressurized fluid flowing through passageway 49 functions to actuate air cylinder 22 and causes the connecting rod 23 to move placing sealing member 25 in contact with the valve seat 26 to prevent the passage of blasting media into the first upper chamber 28. Pressurized fluid from sequencing valve 48 flows through a passageway 50 to actuate the pop-up valve 33 within the first upper chamber 28. The actuated pop-up valve 33 forces and holds the sealing surface 34 in contact with the pop-up sealing gasket 35. During the first step the pop-up valve 33 that is within the second lower chamber 29 is in a deactuated state and passageway 31 between the first upper chamber 28 and the second lower chamber 29 is substantially unobstructed.

The media level sensor 53 in the second lower chamber 29 is monitored for the media level in the chamber. Generally, the blasting media substantially covers the second lower chamber level sensor 53 in this first step, and when the sensor 53 becomes uncovered sensor 53 turns off and indexes the blasting media apparatus 10 to the second step. Uncovering of the second lower chamber level sensor 53 occurs because blasting media is discharged from the second lower chamber 29 through exit aperture 110.

In the second step the upper chamber pressurization valve 43 remains in an off state thereby maintaining the fluid pressure within the first upper chamber 28. Sequencing valve 48 switches on thereby redirecting the flow of pressurized fluid which causes air cylinder 22 to be deactuated such that the seating member 25 is unseated from valve seat 26. The fluid pressure within passageway 50 that had been holding the pop-up valve 33 in the first upper chamber 28 in a seating relationship with seat 35 is vented, however, the fluid pressure within the first upper chamber 28 has not been vented and is sufficient to hold the pop-up valve 33 in a closed position. Pressurized fluid passes from sequencing valve 48 through passageway 56 to actuate the pop-up valve 33 in the second lower chamber 29 such that sealing surface 34 forms a substantially fluid tight seal with the pop-up sealing gasket 35. Closing of the pop-up valve 33 occurring when no substantial pressure differential exists between the first upper chamber 28 and the second lower chamber 29. A three second time delay is provided to allow for the pop-up valve 33 within the second lower chamber 29 to form a fluid tight seal before the blast media apparatus indexes to the third step.

In step 3 upper chamber pressurization valve 43 turns on thereby allowing the release of fluid through a passageway 57, from the first upper chamber 28. A quick exhaust valve 58, that is directly mounted to the pressure vessel 27, allows the venting of fluid from first upper chamber 28. Quick exhaust valve 58 preventing the backflow of fluid carrying blasting media into the control passageway network 47. After the fluid pressure in the first upper chamber 28 has been substantially relieved the pop-up valve 33 retracts to an open state such that the sealing surface 34 no longer abuts pop-up sealing gasket 35. The retraction of pop-up valve 33 is caused by a spring force associated with the pop-up valve 33 and naturally occurring gravitational forces. During step 3 the blasting media flow control valve 15 remains open to allow the passage of blasting media into the first upper chamber 28 where it accumulates because the blasting media cannot escape from chamber 28 while the pop-up valve 33 in the second lower chamber 29 is closed. Upon the accumulation of a sufficient level of blasting media within the first upper chamber 28 the blasting medial level sensor 53 is covered thereby turning the sensor on and initiating the fourth step.

In the fourth step the sequencing valve 48 is switched to an off condition thereby allowing the passage of pressurized fluid through passageway 49 which closes the blasting media flow control valve 15. After the blasting media flow control valve 15 is fully closed the pop-up valve 33 in the first upper chamber 28 closes to form a substantially fluid tight seal for first upper chamber 28. A time delay allows for the upper pop-up valve to close and seal before pressurizing the upper chamber, and in the preferred embodiment the delay is three seconds. By closing the blasting media flow control valve 15 first their is minimal or no contamination of the seal formed between the sealing surface 34 and sealing gasket 35. The cylinder actuating the pop-up valve 33 within the second lower chamber 29 is depressurized, however the sealing surface 34 remains in sealing contact with the pop-up sealing gasket 35 because of the fluid pressure differential between the first upper chamber 28 and the second lower chamber 29.

In step five the upper chamber pressurization valve 43 switches off to allow the passage of pressurized fluid into the first upper chamber 28. When the fluid pressure within first upper chamber 28 reaches a steady state condition the pressure differential between the first upper chamber 28 and second lower chamber 29 is minimal. The minimal force can no longer hold the pop-up valve in a closed position as the spring force and gravitational force acting on the pop-up valve 33 within the second lower chamber 29 force it to open. Thereafter the blasting media accumulated in the first upper chamber 28 flows by gravity into the second lower chamber 29. Upon the media level switch 53 in the first upper chamber 28 being uncovered it switches off and the blasting media apparatus 10 cycles to its final step.

In the final step all valves and actuators remain in the steady state condition of the previous step and a time delay of ten seconds is initiated to allow the blasting media to empty into the lower chamber 29. Upon the elapse of the ten second delay the apparatus returns to the first step.

Each of the blast pots 16 being cycled at a relatively high rate so as to not to interrupt the delivery of blasting media to the high pressure high velocity fluid stream. The blast pots 16 being designed and constructed such that their cycle time is less than five minutes. In a preferred form of the present invention the cycle time is in the range of about 20–45 seconds; this cycle time being more applicable for the delivery of blasting media having a density less than steel. A more preferred form of the blasting pots 16 operates with a cycle time of about 20 seconds. In the most preferred form of the present invention the cycle time for the blasting pots 16 is within a range of about 45–90 seconds. Cycle times within the range of about 45–90 seconds are particularly applicable for steel blasting media. Other cycle times are contemplated herein dependent upon the characteristics of the blasting media and the surface to be conditioned.

The blasting apparatus 10 and blast pots 16 deliver a relatively large volume of blasting media compared to the total volume of each blast pot 16. A ratio (hereinafter RATIO) utilized as an indicator of this characteristic is defined by: cubic inches of blasting media per hour passed through the blasting pot/cubic inches of volume per blast pot. The blast pots 16 being designed and constructed such that the RATIO is greater than 2.5/hour. In the preferred form of the present invention the preferred RATIO being in a range of about (17–38)/hour. In the preferred form of the present invention the preferred RATIO occurring when the cycle time is in the range of about 20 to 45 seconds. In a more preferred form of the present invention the more preferred RATIO being about 38/hour. The more preferred RATIO occurring in a blast pot having a cycle time of about 20 seconds. In the most preferred embodiment of the present invention the blast pot having a most preferred RATIO within a range of about (8.5–17)/hour. The most preferred RATIO occurring when the cycle time is within a range of about 45 to 90 seconds. It is understood that the above RATIO's are not intended to be limiting and that other RATIO's are contemplated herein. Further, the RATIO having units of (volume$^3$/hour)/volume$^3$, which simplifies algebraically to 1/hour.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for introducing blasting media into a fluid stream for delivery to a surface, comprising:

a mechanical housing for the receipt of blasting media therein, a portion of said housing being open to ambient conditions; and a plurality of gravity fed plural chambered blasting pots coupled to said mechanical housing, said plurality of blasting pots receiving blasting media from said housing and releasing the blasting media into the fluid stream, wherein each of said blasting pots includes a flow control valve, said flow control valve for controlling blasting media flow from said mechanical housing to said blasting pots.

2. The apparatus of claim 1, wherein said apparatus is coupled to a mobile apparatus, and wherein said mechanical housing includes a plurality of sloped sides for funneling the blasting media to said blasting pots.

3. The apparatus of claim 1, wherein said flow control valve includes a sealing member moveable to an abutting relation with a seat, and which further includes an auxiliary actuation device to move said sealing member to an abutting relationship with said seat, and wherein said sealing member is substantially cylindrical.

4. The apparatus of claim 1, wherein said plural chambers are formed by a dividing member, said dividing member having a passageway formed therethrough.

5. The apparatus of claim 4, wherein the cross-sectional area of said passageway is about 1/20 of the cross-sectional area of said blasting pot.

6. The apparatus of claim 4, wherein the cross-sectional area of said passageway is about 1/16 of the cross-sectional area of said blasting pot.

7. The apparatus of claim 4, wherein said dividing member has a lower surface, said lower surface including a seat for receiving a sealing surface of a pop-up valve thereagainst.

8. The apparatus of claim 7, wherein said scaling surface is defined on a half sphere portion of said pop-up valve, and wherein at least a portion of said scaling surface is of a polyurethane material.

9. The apparatus of claim 1, wherein said plurality of blasting pots includes six blasting pots, and wherein each of said blasting pots is pressurizable.

10. The apparatus of claim 1, wherein each of said blasting pots include a blasting media level sensor to sense the presence of blasting media.

11. The apparatus of claim 1, wherein each of said blasting pots define an exit aperature at its lowest point for allowing discharge of the blasting media.

12. The apparatus of claim 11, wherein said exit aperature defines an area less than an area defined by a passageway between said upper and lower chambers.

13. The apparatus of claim 1, wherein:

said mechanical housing includes a plurality of sloped sides for funneling the blasting media to said blasting pots;

the apparatus further includes a pop-up valve;

wherein said flow control valve includes a substantially cylindrical sealing member moveable to an abutting relation with a seat;

the apparatus further includes an auxiliary actuation device to move said sealing member to an abutting relationship with said seat;

said plural chambers are formed by a dividing member, said dividing member having a passageway formed therethrough, and said dividing member has a lower surface, said lower surface including a seat for receiving a sealing surface of said pop-up valve thereagainst, wherein said sealing surface is defined on a half sphere portion of said pop-up valve;

the apparatus further includes a blasting media level sensor to sense the presence of blasting media; and each of said blasting pots define an exit aperture at its lowest point for allowing discharge of the blasting media.

14. The apparatus of claim 13, wherein the cross-sectional area of said exit aperature is less than the cross-sectional area of said passageway;

said sealing surface is of a polyurethane material; and said apparatus is coupled to a mobile apparatus.

15. The apparatus of claim 14, wherein each of said blasting pots includes a quick exhaust valve for allowing automated venting of fluid therefrom, and wherein said pop-up valve is spring-biased to an open position, and further wherein each of said blasting pots are formed from a cylindrical pipe.

16. An apparatus for introducing blasting, media into a fluid stream for delivery to a surface comprising:

a pressurizable vessel having a blasting media inlet and a blasting media outlet;

a sealing valve coupled with said vessel for forming a substantially fluid tight seal at said inlet to prevent the escape of fluid through said inlet; and a blasting media flow control valve coupled with said vessel for controlling the flow of blasting media into said inlet without having to close said sealing valve.

17. The apparatus of claim 16, wherein said apparatus is coupled to a mobile apparatus.

18. The apparatus of claim 16, wherein said flow control valve includes a moveable cylindrical sealing member positionable so as to abut a secat, and which further includes an auxiliary actuation device to move said cylindrical sealing member relative to said seat.

19. The apparatus of claim 18, wherein said vessel is formed from a cylindrical pipe.

20. The apparatus of claim 19, wherein:

said vessel includes two independently pressurizeable chambers formed by a dividing member, said dividing member having a passageway therebetween;

each of said chambers includes a blasting media level sensor to sense the presence of blasting media;

said vessel has an exit aperature at its lowest point for allowing discharge of the blasting media; and said vessel includes a pressure isolation valve to isolate said vessel from a pressure source.

21. The apparatus of claim 20, wherein;

said sealing valve defines a pop-up valve closeable independent of the pressure within said vessel, at least a portion of said pop-up valve formed of a polyurethane material;

the cross-sectional area of said passageway is in the range of about 1/20 to 1/16 of the cross-sectional area of said vessel;

said exit aperature having a cross-sectional area less than the cross-sectional area of said passageway;

said dividing member is sloped towards said passageway to facilitate passage of blasting media therethrough, said dividing member defines a lower surface including a valve seat around said passageway for receiving a sealing surface of a pop-up valve, said pop-up valve forming a substantially fluid tight seal at said passageway to prevent the escape of fluid therethrough; and the apparatus includes a plurality of vessels in the range between 2 and 50.

22. An apparatus for introducing blasting media into a high pressure high velocity air stream for delivery to a surface, comprising:

a dual chambered pressure vessel having a first and second chamber that are disposed in fluid communication with one another;

a first valve for controlling the flow of blasting media into said vessel;

a second valve for controlling the flow of blasting media between said first and second chambers; and means for controlling actuation of said valves at a high rate so as to replenish said chambers and not interrupt the delivery of blasting media to the high-pressure high velocity air stream.

23. The apparatus of claim 22, wherein said first and second chambers are separated by a dividing member, said dividing member having a passageway formed therethrough, said dividing member has a lower surface including a seat for receiving a sealing surface of said second valve thereagainst.

24. The apparatus of claim 23, wherein said second valve defines a pop-up valve, and wherein said pop-up valve having a sealing surface defined on a half sphere portion of said pop-up valve, and wherein at least a portion of said sealing surface is of a polyurethane material.

25. The apparatus of claim 24, wherein said pressure vessel has an exit aperature at its lowest point for allowing discharge of the blasting media, and wherein the apparatus is coupled to a mobile apparatus.

26. An apparatus for introducing blasting media into an airstream for delivery to a surface, comprising:

a pressurizable vessel having a plurality of chambers for passing blasting media therethrough, said vessel having a blasting media inlet and a blasting media outlet;

a seal engageable with said inlet for forming a substantially fluid tight seal;

a valve engageable with said inlet for controlling the flow of blasting media into said inlet without having to engage said seal with said inlet; and blasting media delivery means for delivering the blasting media into the airstream, wherein a ratio of the blasting media volume passing through the vessel per hour divided by the vessel volume is greater than 2.5/hour.

27. The apparatus of claim 26, wherein said ratio is in the range of 17/hour to 38/hour.

28. The apparatus of claim 26, wherein said ratio is about 38/hour.

29. The apparatus of claim 26, wherein said ratio is in the range of 8.5/hour to 17/hour.

30. An apparatus for introducing blasting media into a fluid stream for delivery to a surface, comprising:

a plurality of pressure vessels, a mobile apparatus having said plurality of pressure vessels coupled thereto;

a mechanical housing having a plurality of sloped sides for funneling the blasting media to said plurality of pressure vessels;

each of said plurality of pressure vessels, comprising: a blasting media inlet and a blasting media outlet, said outlet positioned at a lowest point of said pressure vessel for allowing discharge of the blasting media; a first upper chamber and a second lower chamber within said pressure vessel, at least one of said chambers having a blasting media sensor for sensing a level of blasting media therein; and, an auxiliary actuated pop-up valve between said chambers for controlling flow of media therebetween, said pop-up valve being closeable when there is no substantial pressure differential between said chambers;

a flow control valve for controlling blasting media flow from said mechanical housing to each of said pressure vessels, said flow control valve includes a substantially cylindrical sealing member moveable to an abutting relation with a first seat; and an auxiliary actuation device to move said sealing member to an abutting relationship with said first seat.

31. The apparatus of claim 30, wherein said first upper chamber and said second lower chamber are separated by a dividing member, said dividing member having a passageway formed therethrough.

32. The apparatus of claim 31, wherein said dividing member has a lower surface, said lower surface including a second seat for receiving a sealing surface of said auxiliary actuated valve thereagainst.

33. The apparatus of claim 32, wherein said sealing surface is defined on a half sphere portion of said auxiliary actuated pop-up valve, and wherein at least a portion of said sealing surface is of a polyurethane material.

34. The apparatus of claim 33, wherein each of said first upper chamber and said second lower chamber includes one of said blasting media sensor to sense the presence of blasting media.

35. The apparatus of claim 34, wherein said exit aperature defines a cross-sectional area less than the cross-sectional area of said passageway between said upper and lower chambers.

* * * * *

UNITED STATES PATENT AND TRADEMARK OFFICE

CERTIFICATE OF CORRECTION

PATENT NO. : 6,152,810
APPLICATION NO. : 09/110610
DATED : November 28, 2000
INVENTOR(S) : John C. Drenter It is certified that error appears in the above-identified patent and that said Letters Patent is hereby corrected as shown below:

In column 5, lines 13 and 16, please delete "the," first occurrences.

In column 5, line 38 , please change "their" to - - there - -.

In column 7, line 44, please change "their" to - - there - -.

In column 8, line 5, please delete "to," first occurrence.

In column 9, lines 21 and 23, please change "scaling" to - - sealing - - .

In column 9, line 32, please change "aperature" to - - aperture - -.

In column 10, line 5, please delete the comma.

In column 10, line 19, please change "secat" to - - seat - -.

In column 10, line 44, please change "aperature" to - - aperture - - .

In column 12, line 38, please change "aperature to - - aperture - - .

Signed and Sealed this

Eighth Day of August, 2006

JON W. DUDAS
*Director of the United States Patent and Trademark Office*